US011264723B2

(12) United States Patent
Wu et al.

(10) Patent No.: US 11,264,723 B2
(45) Date of Patent: Mar. 1, 2022

(54) SLOT ANTENNAS

(71) Applicant: Hewlett-Packard Development Company, L.P., Spring, TX (US)

(72) Inventors: Shih Huang Wu, Spring, TX (US); Kuan-Ting Wu, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 99 days.

(21) Appl. No.: 16/754,970

(22) PCT Filed: Nov. 15, 2017

(86) PCT No.: PCT/US2017/061656
§ 371 (c)(1),
(2) Date: Apr. 9, 2020

(87) PCT Pub. No.: WO2019/098998
PCT Pub. Date: May 23, 2019

(65) Prior Publication Data

US 2020/0303825 A1 Sep. 24, 2020

(51) Int. Cl.

| | |
|---|---|
| ***H01Q 13/10*** | (2006.01) |
| *H01Q 1/24* | (2006.01) |
| *H01Q 1/52* | (2006.01) |
| *H01Q 13/18* | (2006.01) |
| *H01Q 9/28* | (2006.01) |

(52) U.S. Cl.
CPC ..... *H01Q 13/10* (2013.01); *H01Q 1/242* (2013.01); *H01Q 1/528* (2013.01); *H01Q 9/28* (2013.01); *H01Q 13/18* (2013.01)

(58) Field of Classification Search
CPC ..... H01Q 13/10; H01Q 13/18; H01Q 1/242; H01Q 9/28; H01Q 1/528
See application file for complete search history.

(56) References Cited

U.S. PATENT DOCUMENTS

| | | | | |
|---|---|---|---|---|
| 7,595,759 | B2 | 9/2009 | Schlub | |
| 8,223,082 | B2 | 7/2012 | Chiang et al. | |
| 8,325,096 | B2 | 12/2012 | Ayala et al. | |
| 8,665,164 | B2 * | 3/2014 | Hill | H01Q 5/342 343/767 |
| 9,484,621 | B2 | 11/2016 | Fahlgren et al. | |
| 9,634,378 | B2 | 4/2017 | Golko et al. | |
| 2010/0321255 | A1 | 12/2010 | Kough | |
| 2013/0194138 | A1 | 8/2013 | Hammond | |
| 2016/0294045 | A1 | 10/2016 | Shiu et al. | |

OTHER PUBLICATIONS

Lee, C-T., Low-cost, Direct-fed Slot Antenna Built in Metal Cover of Notebook Computer for 2.4-/5.2-/5.8-ghz WLAN Operation, Mar. 7, 2017, http://ieeexplore.ieee.org/document/7873296/.

* cited by examiner

*Primary Examiner* — Joseph J Lauture
(74) *Attorney, Agent, or Firm* — HPI Patent Department

(57) ABSTRACT

Examples of slot antennas are described herein. In an example, the slot antenna includes a substrate and an antenna element disposed on the substrate to transmit and receive signals. The substrate is porous.

12 Claims, 4 Drawing Sheets

SLOT ANTENNAS

BACKGROUND

Electronic devices, such as mobile devices, tablets, and computers, may be provided with wireless communication capabilities. For example, the electronic devices may be provided with slot antennas for receiving and transmitting electromagnetic signals. A slot antenna may convert electric power into electromagnetic waves. The slot antenna may include a radiating element that may radiate the converted electromagnetic waves.

BRIEF DESCRIPTION OF DRAWINGS

The following detailed description references the drawings, wherein.

DETAILED DESCRIPTION

Figure 1:
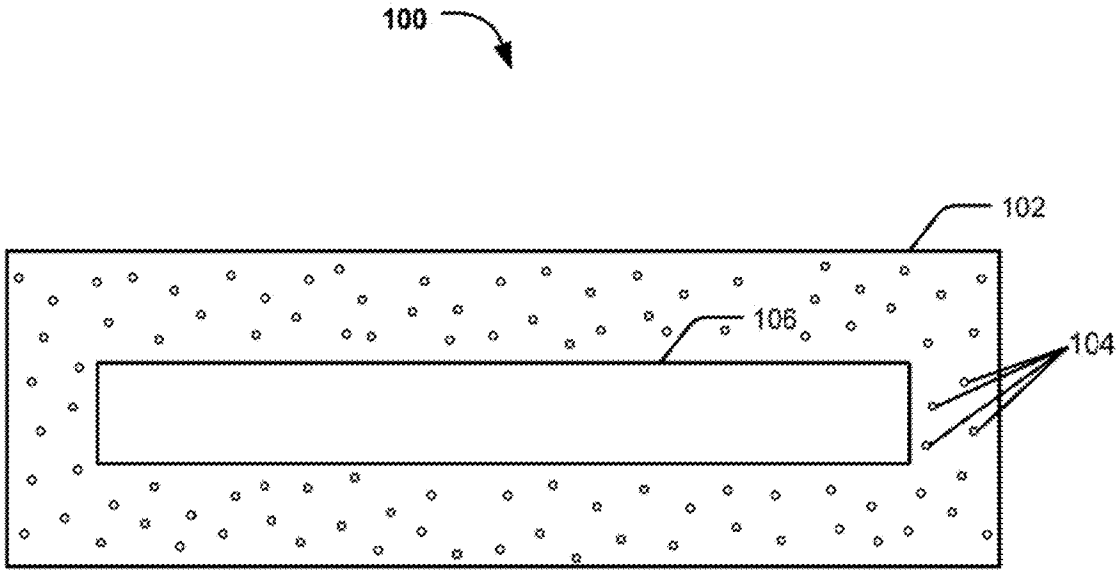
FIG. 1 illustrates a slot antenna, according to an example.

An antenna is a device for transmitting or receiving electromagnetic waves of a specific band of frequencies. Examples of types of antennas may include, but are not limited to, a monopole, a dipole, a slot antenna, and a patch antenna. Application of an antenna may be dependent on a profile, such as a height and width, of the antenna. For example, owing to the low profile of slot antennas, most electronic devices, such as mobile phones, laptops, and notebooks, are provided with slot antennas.

A slot antenna usually includes a substrate on which an antenna element may be disposed. For example, the antenna element may include a radiating element, a feeder, and the like. The substrate employed in slot antennas is usually a non-porous dielectric material. The non-porous dielectric substrate may have a high dielectric constant, which may lead to a high energy loss factor and low signal transmission efficiency.

The present subject matter describes slot antennas having a substrate of low dielectric constant. The slot antennas of the present subject matter facilitate the reduction of the energy loss factor and increasing the signal transmission efficiency of the slot antennas. The present subject matter also describes enclosures for electronic devices, and electronic devices implementing such slot antennas.

According to an aspect of the present subject matter, the slot antenna may include a substrate, where the substrate is formed of a porous material. In an example, the porous material may include a thermosetting polymer in the form of micro-spherical hollow particles. Though the hollow particles are described here as spherical, the hollow particles may be of other shapes. The micro-spherical hollow particles may include outer shells having a hollow core. The outer shells may be made of epoxy resin, melamine formaldehyde, polyester resin, urea formaldehyde or a combination thereof. The micro-spherical hollow particles introduce vacant spaces or pores, in the substrate. The pores hold air, thereby making the substrate porous in nature. The pores introduced by the micro-spherical hollow particles reduce the dielectric constant of the substrate, thereby enhancing the signal transmission efficiency of the slot antenna. In an example, the substrate may have a ground plane.

Further, the slot antenna may include an antenna element disposed on the substrate to transmit and receive signals. The slot antenna may be disposed on an outer body of an electronic device. In an example, the antenna element may include a feeder and a radiator electrically connected to the substrate to cause excitation of a slot in the outer body of the electronic device. The slot may be excited by application of electric current across the slot to generate magnetic field from the slot.

The above aspects are further described in conjunction with the following figures and associated description below. It should be noted that the description and figures merely illustrate the principles of the present subject matter. Further, various arrangements may be devised that, although not explicitly described or shown herein, embody the principles of the present subject matter and are included within its scope. The manner in which the systems depicting various implementations of slot antennas are explained in detail with respect to FIGS. 1-4.

FIG. 1 illustrates a slot antenna 100, according to an example. The slot antenna 100 may be disposed over a slot (not shown) of an enclosure, such as a conductive enclosure of an electronic device (not shown in FIG. 1). Examples of the electronic device may include, but are not limited to, a personal computer, a laptop, a mobile phone, a remote control, and a personal digital assistant (PDA).

The slot antenna 100 includes a substrate 102, such as a printed circuit board (PCB). The substrate 102 may be disposed on the conductive enclosure of the electronic device. In an example, the substrate 102 may be formed of a porous material. The porous material may be a thermoplastic polymer selected from polymethacrylimide, fluorinated polymer, polyethylene, polypropylene, ethyl vinyl acetate, aromatic polymers, silicon-containing polymers, polycarbonate, poly-ether-sulfone (PES), nylon, polyurethane, composite materials or a combination thereof.

In an aspect, the porous material may include a thermosetting polymer. In an example, the thermosetting polymer may be added in the thermoplastic polymer through a compounding process. The compounding process may include preparing plastic formulations by mixing polymers and additives in a molten state. The compounding process may change the physical, thermal, and electrical characteristics of the plastics. The thermosetting polymer as disclosed in the present subject matter may be in the form of micro-spherical hollow particles. An example of which may be represented by particles 104 in FIG. 1. Accordingly, in the present example, the micro-spherical hollow particles are blended with molten thermoplastic polymer.

Thus, the porous material includes the micro-spherical hollow particles 104 having a particle size in a range of about 10 μm to 200 μm. The hollow particles 104 introduce air in the substrate 102, thereby causing reduction of the dielectric constant of the substrate 102. For example, the porous material has a dielectric constant in a range of about 1.1 to 2. The porous material has a porosity percentage in a range of about 5% to 45%. A high porosity percentage facilitates the reduction of dielectric loss factor, thereby enhancing radiation performance of the slot antenna 100.

In an example, the micro-spherical hollow particles 104 may include outer shells having a hollow core. The outer shells may be made of epoxy resin, melamine formaldehyde, polyester resin, urea formaldehyde, or a combination thereof. The micro-spherical hollow particles 104 are added in the porous material in about 1 weight percent to about 5 weight percent of the porous material. The micro-spherical hollow particles 104, thus provide porosity to the substrate 102.

In an example, the slot antenna 100 may include an antenna element 106 disposed on the substrate 102. The antenna element 106 may include electronic components, such as a radiator and a feeder (not shown), to transmit and receive signals. In the present example, the slot antenna 100 may be of any shape, such as an L-shape, a linear shape, and the like. Details pertaining to the antenna element 106 are described in conjunction with FIG. 2.

Figure 2:
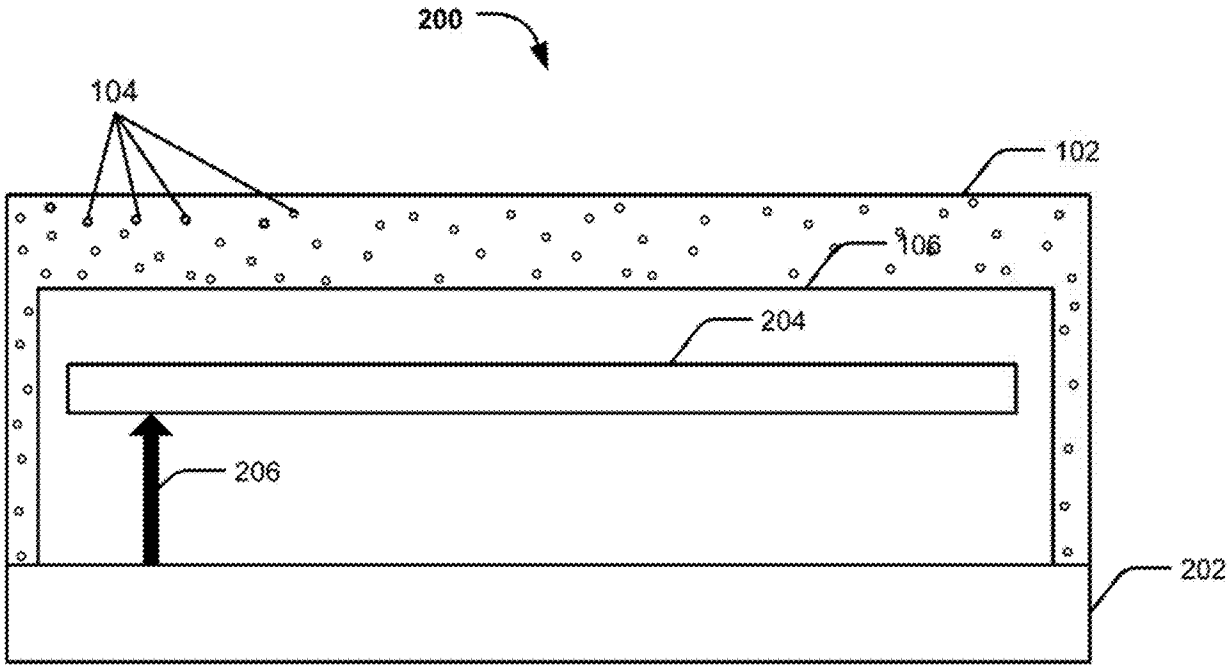
FIG. 2 illustrates a slot antenna, according to another example.

FIG. 2 illustrates a slot antenna 200, according to another example. The slot antenna 200 includes the substrate 102 and the antenna element 106 disposed on the substrate 102. In an example, the substrate 102 may define a ground plane 202. The ground plane 202 may be a portion of the substrate 102 that does not include any electrical component. For instance, the ground plane 202 may act as a reflecting surface for radio waves. The ground plane 202 may be made of copper foil. The copper foil may be connected to the conductive enclosure and may serve as a return path for current from different components on the substrate 102. The ground plane 202 may also reduce electrical noises that may be created due to adjacent circuit traces.

Further, as mentioned with respect to FIG. 1, the substrate 102 is made of a porous material. The porous material is made of a polymer or a combination of polymers. In an example, the porous material may include micro-spherical hollow particles, such as particles 104, made of thermosetting polymer. The micro-spherical hollow particles have a particle size in a range of about 10 μm to 200 μm.

In an aspect, the antenna element 106 may include a radiator 204 and a feeder 206. In an example, the radiator 204 may be made of metal traces. The radiator 204 may be connected to the feeder 206 to cause excitation of a slot (not shown) of an enclosure of the electronic device. In an example, the radiator 204 may have different shapes based on frequency demands of the electronic device. Examples of the shapes of the radiator 204 may include, but are not limited to, an L-shaped radiator, a T-shaped radiator, and an E-shaped radiator.

Further, the feeder 206 may be electrically coupled to the ground plane 202. The feeder 206 may feed radio waves into the slot antenna 200. The feeder 206 may also be used for collecting incoming radio waves, converting them to electric currents and transmitting the electric current to a receiver (not shown). In an example, the feeder 206 may be a line feed, a coaxial feed, a micro-strip feed, and the like.

Figure 3:
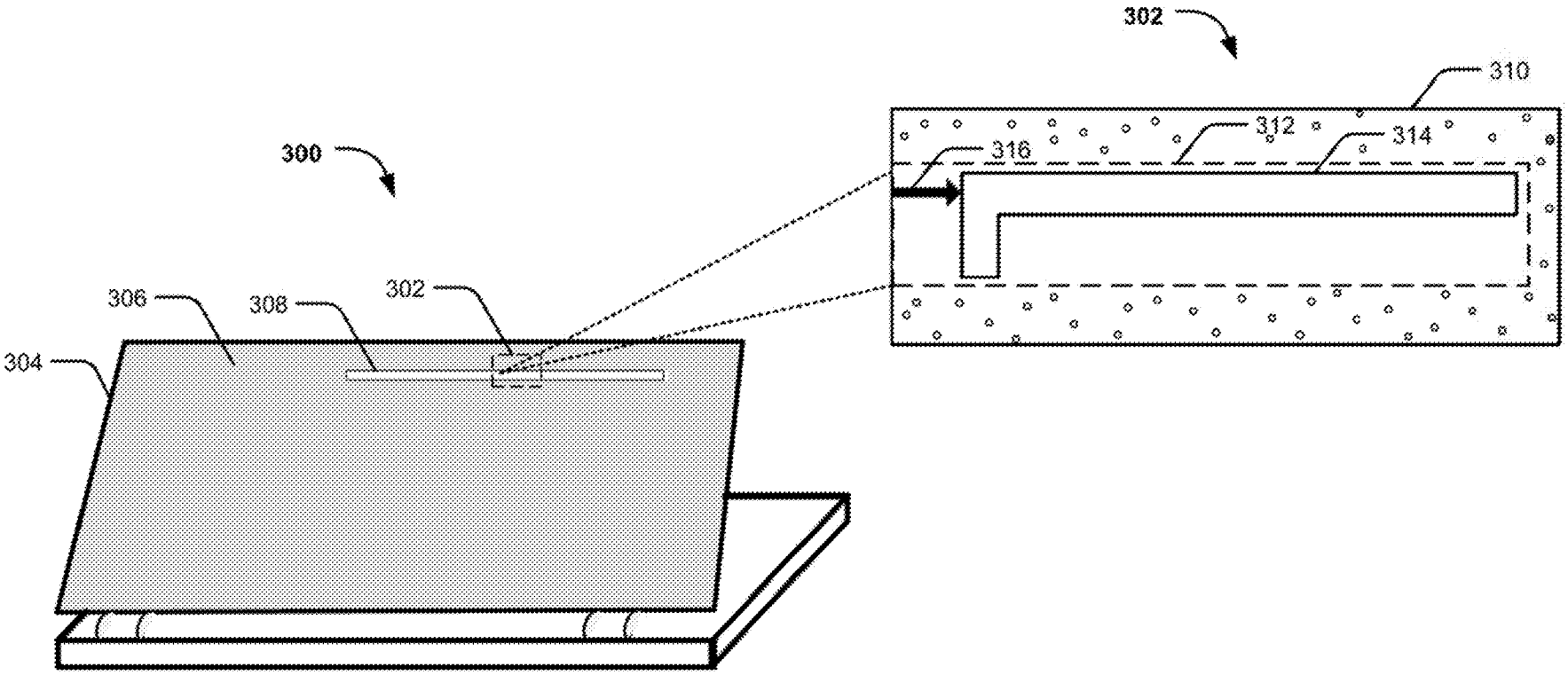
FIG. 3 illustrates an electronic device embedded with a slot antenna, according to an example.

FIG. 3 illustrates an electronic device 300 embedded with a slot antenna 302, according to an example. In the present example, the electronic device 300 is depicted as a laptop, however, the electronic device 300 may include a personal computer (PC), a smartphone, a tablet, a notebook, a mobile phone, and the like. The electronic device 300 includes an enclosure 304 having a conductive portion 306. In an example, the enclosure 304 may be a case or a body of the electronic device 300. In an example, the enclosure 304 may be constructed of a metal, such as aluminium, aluminium alloy, magnesium alloy, carbon fiber, and composite material.

The slot antenna 302 may be located within the enclosure 304, on the conductive portion 306, e.g., behind a display (not shown) of the electronic device 300, or at other suitable locations within the electronic device 300. In an example, the conductive portion 306 may include a slot 308. The slot 308 may be filled with a dielectric, such as air or a solid dielectric, such as plastic or epoxy that do not substantially affect radio-frequency antenna signals. The slot 308 may be of any suitable shape and may be created on the conductive portion 306 of the enclosure 304. Further, the slot 308 may extend throughout the conductive portion 306 or may be at a specific region of the conductive portion 306. In an example, a length of the slot 308 may determine an operating frequency of the slot antenna 302.

The slot antenna 302 disposed on the conductive portion 306 of the electronic device 300 may include a substrate 310. The substrate 310 is similar to the substrate 102. In an example, the substrate 310 is disposed on the conductive portion 306 of the enclosure 304. In an example, the substrate 310 is insert molded on the conductive portion 306 of the electronic device 300. In the present example, the substrate 310 may be disposed on the conductive portion 306 by using any other technique, such as injection molding and overmolding.

Further, the substrate 310 is formed of a porous material. The porous material may include a thermoplastic polymer that may be selected from one of polymethacrylimide, fluorinated polymer, polyethylene, polypropylene, ethyl vinyl acetate, aromatic polymers, silicon-containing polymers, polycarbonate, poly-ether-sulfone (PES), nylon, polyurethane, composite materials or a combination thereof. In an example, the porous material may include a thermosetting polymer in the form of micro-spherical hollow particles.

The hollow particles introduce pores, filled with air, in the substrate 310. The hollow particles make the substrate 310 porous. The micro-spherical hollow particles may include outer shells having a hollow core. The outer shells may be made of epoxy resin, melamine formaldehyde, polyester resin, urea formaldehyde, or a combination thereof. The micro-spherical hollow particles may have a particle size in a range of about 10 μm to 200 μm.

In addition, introduction of the air in a structure of the substrate 310 reduces the dielectric constant of the substrate 310. For example, the dielectric constant of the porous material is in a range of about 1.1 to 2. Low dielectric constant of the porous material in turn causes reduction of dielectric loss factor, thereby providing enhanced signal transportation of the slot antenna.

In an aspect, the slot antenna 302 may include an antenna element 312 disposed over the substrate 102 on the conductive portion 306. In an example, the antenna element 312 may include a radiator 314 and a feeder 316. The antenna element 312 may cause excitation of the slot 308 to transmit and receive signals.

To fabricate the slot antenna 302, the substrate 310 is molded on the conductive portion 306 such that the substrate 310 is placed over the slot 308 of the conductive portion 306 of the electronic device 300. Accordingly, the electronic device 300 may achieve high radiation while transmitting and receiving signals at different frequency bands. Placement of the antenna element 312 over the slot 308 of the conductive portion 306 is explained in detail with reference to FIG. 4.

Figure 4:
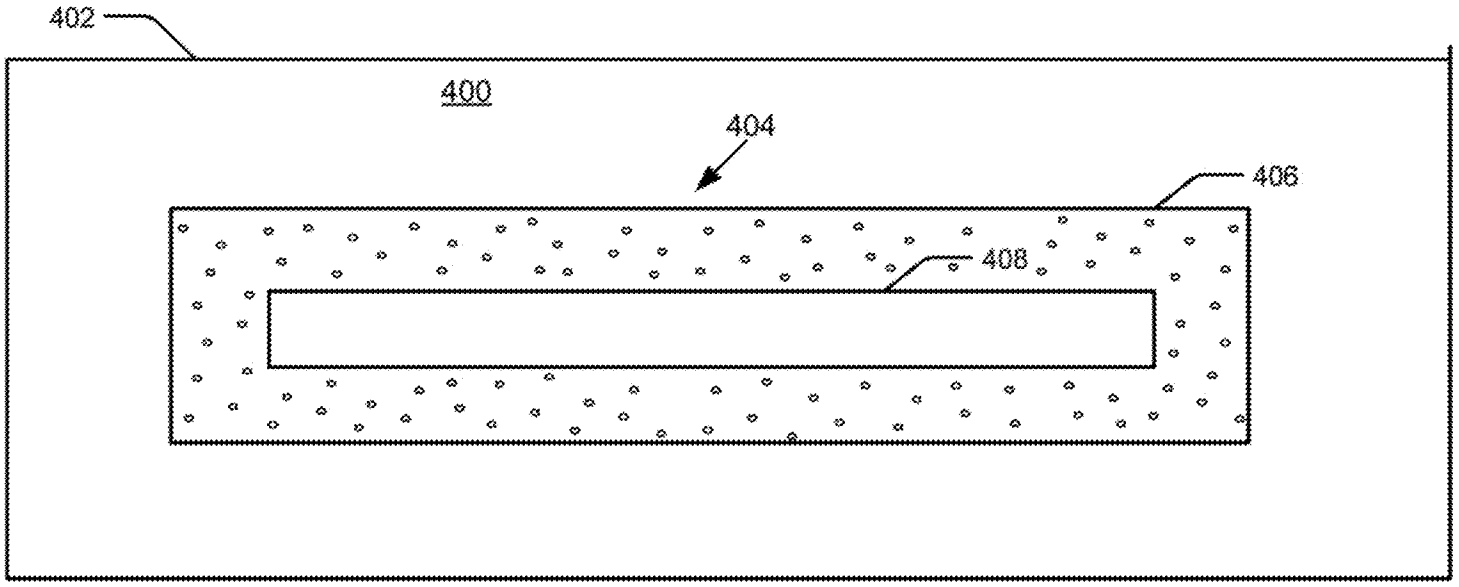
FIG. 4 illustrates an enclosure of an electronic device implementing a slot antenna, according to an example.

FIG. 4 illustrates an outer surface 400 of an enclosure 402 of an electronic device, such as the electronic device 300, implementing a slot antenna 404, according to another example. In an example, the enclosure 402 may include any of the slot antennas 100, 200, and 302 as explained with reference to FIGS. 1, 2, and 3. In an example, the enclosure 402 may be a body or housing of a mobile phone, a digital camera, a laptop, and the like. In an example, the enclosure 402 may be made of a conductive material. Examples of the conductive material may include, but are not limited to, Aluminium, Aluminium alloy, Magnesium alloy, Carbon fibre and composite materials.

In an example, the slot antenna 404 includes a porous substrate 406. The porous substrate 406 may be formed of a polymer matrix that may be filled with micro-spherical hollow particles dispersed therein. In an implementation, the porous substrate 406 may include, a polymer material. Examples of the porous material may include, but is not limited to, polymethacrylimide, fluorinated polymer, polyethylene, polypropylene, ethyl vinyl acetate, aromatic polymers, silicon-containing polymers, polycarbonate, poly-ether-sulfone (PES), nylon, polyurethane, composite materials or a combination thereof.

In an implementation, the micro-spherical hollow particles of the porous substrate 406 may have a particle size in a range of about 10 μm to 200 μm. Further, the porous material of the porous substrate 406 has a density of porosity in a range of about 0.65 g/cm$^3$ to 0.95 g/cm$^3$. In an example, the density of porosity indicates density of pores in the porous substrate. Further, the porous material of the porous substrate 406 has a porosity percentage in a range of about 5% to 45%. A high porosity percentage facilitates the reduction of dielectric loss factor, thereby enhancing radiation performance of the slot antenna 404.

In an example, the micro-spherical hollow particles may include outer shells having a hollow core. The outer shells may be made of epoxy resin, melamine formaldehyde, polyester resin, urea formaldehyde, or a combination thereof. The micro-spherical hollow particles are added in the porous material in about 1 weight percent to about 5 weight percent of the porous material. The micro-spherical hollow particles provide porosity to the porous substrate 406.

Further, the slot antenna 404 may include an antenna element 408 disposed on the porous substrate 406 to transmit and receive signals. The antenna element 408 may include electronic components, such as a radiator and a feeder.

Although implementations of the slot antennas have been described in language specific to structural features and/or methods, it is to be understood that the present subject matter is not necessarily limited to the specific features or methods described. Rather, the specific features and methods are disclosed and explained in the context of a few example implementations of the slot antennas.

We claim:

1. A slot antenna comprising:

a substrate disposable on an outer body of an electronic device, the substrate being formed of a porous material, wherein the porous material comprises micro-spherical hollow particles, and wherein each micro-spherical hollow particle comprises an outer shell made of epoxy resin, melamine formaldehyde, polyester resin, urea formaldehyde or a combination thereof; and an antenna element disposed on the substrate to transmit and receive signals.

2. The slot antenna as claimed in claim 1, wherein the micro-spherical hollow particles have a particle size in a range of about 10 μm to 200 μm.

3. The slot antenna as claimed in claim 1, wherein the porous material has a porosity percentage in a range of about 5% to 45%.

4. The slot antenna as claimed in claim 1, wherein the porous material has a dielectric constant in a range of about 1.1 to 2.

5. An enclosure of an electronic device, the enclosure comprising:

a slot antenna comprising:

a porous substrate comprising micro-spherical hollow particles, wherein the micro-spherical hollow particles have a particle size in a range of about 10 μm to 200 μm; and an antenna element disposed on the porous substrate to transmit and receive signals.

6. The enclosure as claimed in claim 5, wherein the porous substrate comprises one of polymethacrylimide, fluorinated polymer, polyethylene, polypropylene, ethyl vinyl acetate, aromatic polymers, silicon-containing polymers, polycarbonate, poly-ether-sulfone (PES), nylon, polyurethane, composite materials or a combination thereof.

7. The enclosure as claimed in claim 5, wherein the porous substrate has a density of porosity in a range of about 0.65 g/cm3 to 0.95 g/cm3.

8. The enclosure as claimed in claim 5, wherein each micro-spherical hollow particle comprise an outer shell made of epoxy resin, melamine formaldehyde, polyester resin, urea formaldehyde or a combination thereof.

9. An electronic device comprising:

a conductive portion having a slot;

a substrate disposed on the conductive portion, the substrate being formed of a porous material, wherein the porous material comprises micro-spherical hollow particles having a particle size in a range of about 10 μm to 200 μm; and an antenna element disposed over the substrate on the conductive portion, the antenna element to cause excitation of the slot.

10. The electronic device as claimed in claim 9, wherein the substrate is insert molded on the conductive portion.

11. The electronic device as claimed in claim 9, wherein each micro-spherical hollow particle comprises an outer shell made of epoxy resin, melamine formaldehyde, polyester resin, urea formaldehyde or a combination thereof.

12. The electronic device as claimed in claim 9, wherein the porous material comprises one of polymethacrylimide, fluorinated polymer, polyethylene, polypropylene, ethyl vinyl acetate, aromatic polymers, silicon-containing polymers, polycarbonate, poly-ether-sulfone (PES), nylon, polyurethane, composite materials or a combination thereof.

* * * * *